United States Patent [19]

Shirey

[11] 4,394,794

[45] Jul. 26, 1983

[54] METAL FASTENING SYSTEM AND METHOD

[75] Inventor: Richard Shirey, Avon, Ohio

[73] Assignee: Donn Incorporated, Westlake, Ohio

[21] Appl. No.: 226,385

[22] Filed: Jan. 19, 1981

[51] Int. Cl.[3] ..... B23P 11/00; B23P 17/00

[52] U.S. Cl. ..... 29/432; 29/21.1; 29/509; 29/243.5; 29/283.5; 29/798

[58] Field of Search ..... 29/521, 509, 432, 432.1, 29/432.2, 21.1, 243.5, 243.53, 798

[56] References Cited

U.S. PATENT DOCUMENTS

| | | | |
|---|---|---|---|
| 1,649,363 | 11/1927 | Parsons | 29/521 UX |
| 2,254,558 | 9/1941 | Williams | 29/521 X |
| 2,671,361 | 3/1954 | Sandberg | 29/21.1 UX |
| 2,688,890 | 9/1954 | Williams | 29/521 |
| 2,924,312 | 2/1960 | Williams | 29/521 UX |
| 3,022,687 | 2/1962 | Richards | 29/432 UX |
| 3,599,318 | 8/1971 | Behlen | 29/521 X |
| 3,934,237 | 1/1976 | Hafner | 29/432 |

FOREIGN PATENT DOCUMENTS

| | | | |
|---|---|---|---|
| 1029062 | 5/1966 | United Kingdom | 29/432 |

*Primary Examiner*—Charlie T. Moon

*Attorney, Agent, or Firm*—Parne, Gordon, Session, McCoy, Granger & Tilberry

[57] ABSTRACT

A method and apparatus is disclosed for connecting a plurality of metal sheets or the like without fasteners or welding. A die set is disclosed which is operable to cut ribbons of material from each sheet and to displace the ribbons to one side of the sheets where they are deformed to increase their lateral width within a dovetail-shaped die cavity. The die cavity has an increasing cross section in one longitudinal direction so that the deformed ribbons can be removed from the die cavity by longitudinal movement and it is not necessary to provide the die with movable parts for the release of the deformed ribbons. The die cavity is preferably formed with an open end so that movement of the sheets in a direction perpendicular thereto is not required. The method and apparatus can be combined with processing systems having a feed mechanism for feeding the sheets of material. In such combination, the feed required for the processing is also utilized for the removal of the deformed ribbons from the die cavity.

15 Claims, 8 Drawing Figures

METAL FASTENING SYSTEM AND METHOD

BACKGROUND OF INVENTION

This invention provides a novel and improved method and apparatus for fastening or stitching two or more pieces of sheet metal or the like.

PRIOR ART

It is known to connect two or more pieces of sheet metal or the like without the use of fasteners, rivets or welding. One such system, sometimes referred to as stitching, utilizes a die set which cuts ribbon or strip portions from the pieces, displaces such ribbon portions to one side of the plane of the pieces, and then deforms the ribbon portions so that they cannot return through the opening produced when the ribbon is formed. Examples of such stitching systems are illustrated in U.S. Pat. Nos. 2,254,558; 2,668,890; 3,599,318; and 3,934,327.

In each of these patents, a punch and die cooperate to stitch the parts together and each patent requires a die assembly having two or more parts which are relatively movable so that the deformed ribbon portion can be produced without being locked into the die cavity. In some instances, the die parts are spring-loaded to a closed position, and in other instances, the die parts are powered for relative movement.

SUMMARY OF INVENTION

In accordance with the present invention, a stitching system is provided for joining two or more pieces of sheet metal or the like without requiring relatively movable die parts. A simple die structure is provided having a die cavity formed with an entrance throat providing a pair of opposed cutting edges, a back wall or anvil portion, and side walls shaped so that the die cavity back from the entrance throat is wider than the throat. A mating punch having a working end width sized to mate with the throat cooperates with the die to cut a ribbon from each of the pieces being connected, to displace the ribbons out of the plane of the pieces, and to deform the ribbons so that they have a lateral width greater than the opening from which the ribbons were cut. With this structure, a stitch is produced which provides an interlocking structure that secures the pieces together.

The die cavity, however, is formed with a widening taper in one direction which allows the deformed ribbons to be removed from the cavity by relative longitudinal movement between the die and the ribbons in such widening direction. Consequently, it is not necessary to provide relatively moveable die parts which can open to allow removal of the ribbons from the die cavity.

In many instances, the pieces which are to be stitched together are processed by feeding the pieces past the stitching apparatus. In such instance, this feeding movement is used to produce a relative movement for moving the deformed ribbons from the die cavity. When intermittent feed exists, the die set is usually mounted in a fixed location and operates while the pieces are stationary to perform the stitching operation. When a continuous feed is used, the stitching operation is usually performed on the fly while the die set moves with the pieces. In either event, a clearing of the die cavity is accomplished by the feeding movement which already exists.

In the illustrated embodiment, the die is a one-piece structure having a dovetail a cross section in which the side walls are straight walls joining the throat and the back or anvil wall of the die cavity and which diverge as they extend from the throat to the back wall. The die cavity is elongated and the cavity is formed so that the side walls also diverge in one lengthwise direction. Further, at least the wide end of the die cavity is open so that the deformed ribbon material does not have to rise, by movement perpendicular to the sheets, as it moves out of the die cavity. The illustrated embodiment of the die is a one-piece structure; however, if desired, for purposes of manufacture, the die can be made of two or more parts. However, since the die does not require relatively movable parts, no movement is required between the die parts even in instances in which the die is not formed of a single piece.

Because the die, in accordance with the present invention, does not require relatively movable parts, a simple die structure is provided in which wear is minimized and in which reliable operation is achieved without the complications required by the prior art.

DETAILED DESCRIPTION OF THE DRAWINGS

Figure 1:
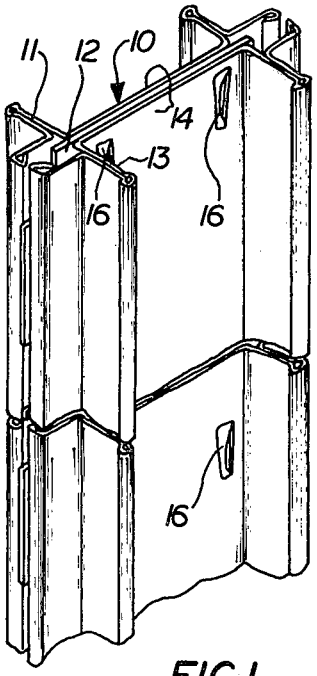
FIG. 1 is a fragmentary, perspective view of a typical product in accordance with this invention, in which three separate pieces of metal are stitched together to provide a permanent assembly.

FIG. 1 illustrates one example of a part or product which is suitable for manufacture with a stitching system in accordance with the present invention. This particular product is a metal stud 10 used in wall constructions. The stud 10 includes three separate sheet metal elements 11, 12, and 13. The element 12 is a flat sheet of metal sandwiched between the elements 11 and 13 which are roll-formed to the illustrated shape. The elements 11 and 13 provide a central web 14 in abutting engagement with the opposite sides of the element 12. The three elements are secured together by a plurality of stitch-type connections 16 made in accordance with the present invention. In the illustrated embodiment, two side-by-side stitch connections 16 are provided adjacent to opposite sides of the web and such pairs of connections are provided in intervals along the length of the web, for example, at about six-inch intervals. These stitch connections provide a permanent connection between the three elements 11, 12, and 13 to secure the elements together. These connections therefore eliminate the need for other types of fastening, such as, for example, fasteners, rivets or welds. Although a particular product is illustrated, it should be understood that this invention is not limited to the manufacture of this particular product or, for that matter, to similar products, and that such product is provided only as an illustration of a type of product which can be economically and efficiently manufactured in accordance with the present invention.

Figure 2:
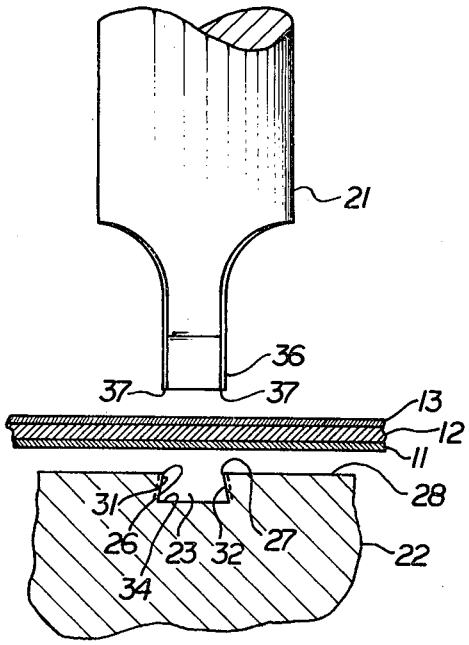
FIG. 2 is an enlarged cross section of the tool and die illustrated with three separate pieces of sheet metal prior to the stitching operation.
Figure 3:
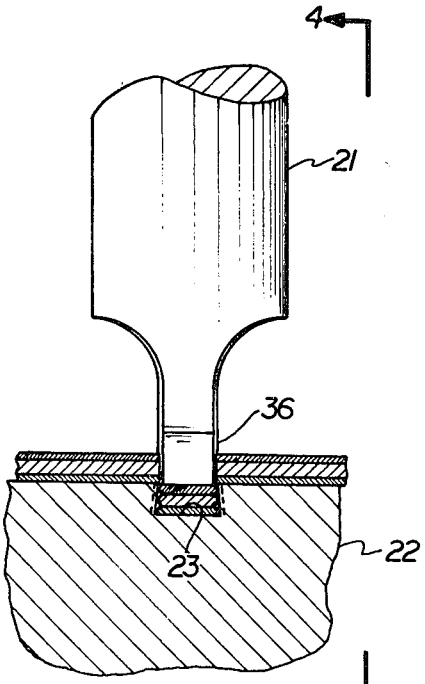
FIG. 3 is a fragmentary section similar to FIG. 2, but illustrating the tool and die assembly at the completion of the stitching operation.
Figure 4:
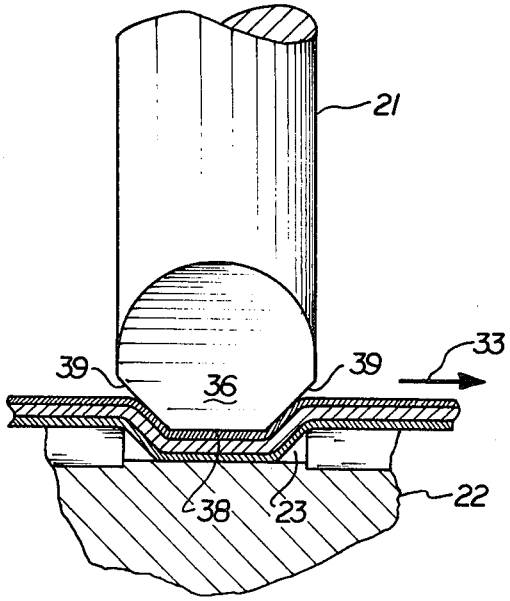
FIG. 4 is a fragmentary side elevation taken along 4—4 of FIG. 3.
Figure 3A:
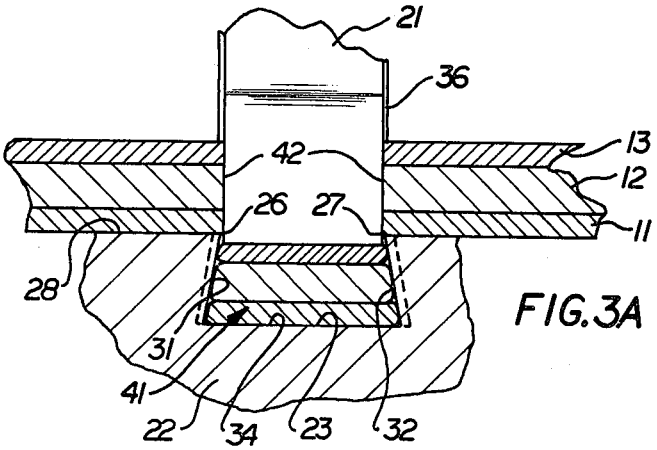
FIG. 3A is an enlarged, fragmentary view similar to FIG. 3, but illustrating the stitch-forming operation at increased scale.
Figure 5:
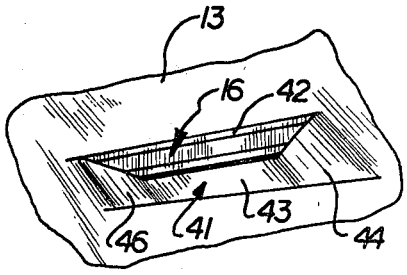
FIG. 5 is an enlarged, fragmentary, perspective view illustrating a completed connection or stitch formed in accordance with this invention.
Figure 6:
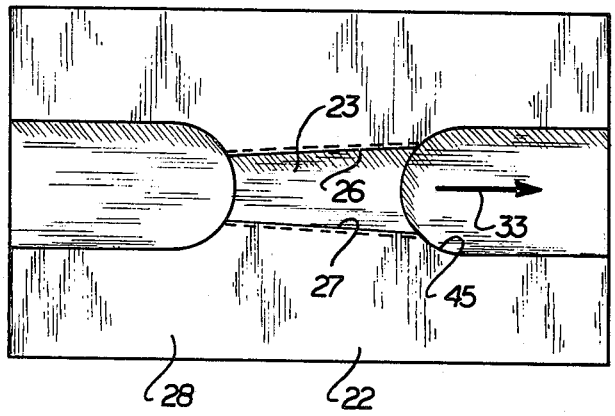
FIG. 6 is a plan view of the die illustrated in the other FIGS.
Figure 7:
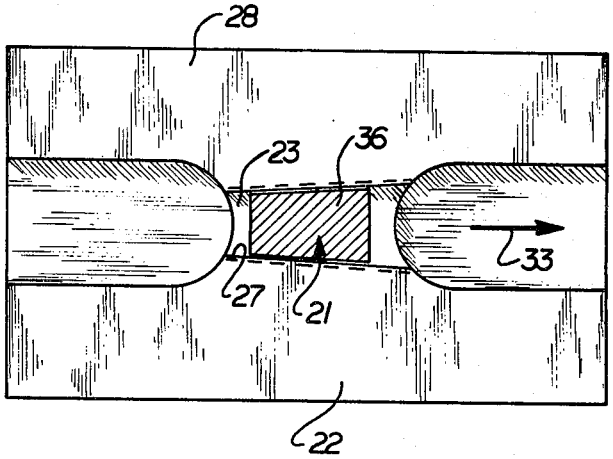
FIG. 7 is a plan view of the die with the tool illustrated in cross section.

Turning now to FIGS. 2–6, a die set in accordance with the present invention includes a punch or tool 21 and a die 22. The die 22 is provided with a die cavity 23 providing a pair of straight cutting edges 26 and 27 which cooperate to define the entrance or throat of the die cavity 23. These cutting edges are formed at the upper surface 28 of the die at the intersection between such upper surface 28 and associated die cavity side walls 31 and 32, respectively. As best illustrated in FIGS. 6 and 7, the die cavity 23 is elongated and the two cutting edges 26 and 27 and the side walls 31 and 32 diverge in the direction of the arrow 33 illustrated in FIGS. 4, 6, and 7. In addition, the side walls 31 and 32 diverge as they extend from the surface 28 to a back surface or anvil surface 34 of the die cavity 23, as best illustrated in FIGS. 2, 3, and 3A. Therefore, the die cavity 23 is provided with a cross section having a dovetail shape in which the width of the die cavity increases as it extends back from the face 28 of the die to a maximum width at the bottom of the die cavity at the back face 34. The width of the die cavity also increases in the direction of the arrow 33 with the right end of the die cavity, as viewed in FIGS. 6 and 7, having a greater width then the left end thereof.

The punch 21 is formed with an end portion 36 having a lateral width sized and shaped to closely fit between the two cutting edges 26 and 27 and providing edges 37 which cooperate with the cutting edges 26 and 27 to provide a shearing action. The longitudinal shape of the end 36 is best illustrated in FIG. 4 and includes a flat extremity 38 and two inclined surfaces 39 which diverge back from the flat end face 38. As best illustrated in FIG. 7, the end of the punch 21 is provided with a width which increases in the direction of the arrow 33 in the same manner as the cavity 23.

In operation, when two or more pieces of metal are to be stitched together, such as the three separate elements 11, 12, and 13 in the illustrated embodiment, the pieces are positioned adjacent to each other between the punch and the die. Normally, the pieces are positioned against the face 28, but in FIG. 2 they are shown spaced therefrom for purposes of illustration. The punch 21 is then pressed down toward the die and moved to the position illustrated in FIGS. 3 and 3A.

The initial travel of the punch after it engages the adjacent element 13 causes an elongated ribbon to be cut from each of the elements 11–13. The cutting of the ribbon is accomplished by the coaction between the cutting edges 26 and 27 and the edges 37 of the punch. As the punch 21 continues to move toward the die, this ribbon assembly 41 consisting of three layers, one cut from each of the elements 11–13, is pressed down into the die cavity 23. When the lowermost surface of the ribbon assembly 41 engages the anvil or back wall 34 of the die cavity, continued movement of the punch 21 causes the portion of the ribbon assembly in alignment with the end face 38 to be deformed or forged so that the ribbon elements flow laterally into relatively close contact with the side walls 31 and 32. In such condition, best illustrated in FIG. 3A, the ribbon assembly 41 has a lateral width greater than the width of the opening 42 formed in the elements 11–13 by the cutting and removal of the ribbon assembly 41. The ribbon, because it is deformed to a greater width, cannot be withdrawn back through the opening and the three elements are permanently stitched together.

Because the ribbon assembly 41, after lateral deformation, closely fits th die cavity 23, it is locked in such cavity against movement in a direction perpendicular to the plane of the sheets. Therefore, the parts would be locked together if it were not for the fact that the die cavity 23 is tapered in the direction of the arrow. After the punch 21 is withdrawn and is clear of the three separate elements, the elements are removed from the die cavity by movement of the three elements relative to the die 28 in the direction of the arrow 33. In practice, it is preferable to provide the die with an enlarged opening 45 having a cross section greater than the cross section of the die cavity both in depth and width at the large open end of the die cavity. This allows the ribbon assembly 41 to be carried by movement in the direction of the arrow clear of the die without requiring movement of the elements away from the face of the die 28.

The stitch 16 produced in this manner is best illustrated in FIG. 5 and includes the opening 42 from which the ribbon is displaced. The ribbon assembly 41 includes a lower flat portion 43 and two inclined ends 44 and 46 formed by the inclined surfaces 39 of the punch. The lower portion 43, however, has a lateral width greater than the width of the opening 42 so that the parts are permanently interconnected. The lower portion is tapered in a lengthwise direction because it is formed in a similarly tapered drive cavity.

The present invention is particularly advantageous in joining parts which are processed by feeding the parts in one direction. For example, the stitching system can be incorporated in the manufacture of a multipiece assembly wherein one part is being roll-formed and must be joined to other parts which may or may not be roll-formed. In such instance, the stitching system is installed in combination with the processing operation which requires longitudinal feeding of the parts.

If the feeding can be accomplished in an intermittent manner, it is preferable to mount the die set, consisting of the tool 21 and die 22, in a fixed location so that the stitching operation can be performed while the two pieces are stationary. The timing of the system is then arranged so that during the feeding operation a completed stitch is moved clear of the die and the parts are moved to a proper position for a subsequent stitching operation.

On the other hand, in instances in which continuous feeding is required, the die set is mounted for limited reciprocating movement in the direction of the feed so that the die set is moved with the part and produces the stitch on the fly while the feeding continues. In such instance, the die set is stopped or held against movement in the direction of feeding after the stitching operation is completed so that the stitch that is formed is moved clear of the die set and the die set returns to its initial position before producing the subsequent stitch.

When the stitching operation is performed in conjunction with other feeding operations, it is not necessary to provide lateral movement of the parts to clear the dies so it is not necessary to modify the existing feed movement.

The die set is normally mounted in a simple power press apparatus (not illustrated) which causes the relative movement of the punch and die to produce the stitching operation.

In many instances, it is preferable to form the die 22 of a single piece of metal, since it is not necessary to provide relative movement between the various surfaces of the die cavity during the stitching operation. However, it is fully within the scope of this invention to form the die 22 of two or more parts which are locked against relative movement in the installation. Further, although the die cavity illustrated has a cross sectional shape of a dovetail, it is within the broader aspects of this invention to provide other shapes so long as the cavity is proportioned so that the ribbon assembly is laterally deformed after it is displaced from a plane of the elements being connected and so that the ribbon can clear the cavity by longitudinal movement.

Although the preferred embodiment of this invention has been shown and described, it should be understood that various modifications and rearrangements of the parts may be resorted to without departing from the scope of the invention as disclosed and claimed herein.

What is claimed is:

1. A die set for fastening two or more sheets of metal or the like together comprising a die and a mating punch, said die providing an elongated die cavity having a pair of opposed cutting edges at the entrance of said cavity, said cutting edges being contained within a single plane, said cavity being defined at least in part by opposed side walls and a back wall, said cavity having a lateral width back from said cutting edges greater than the spacing of said cutting edges, said cutting edges and cavity walls being fixed against relative movement, said punch having a working portion proportioned to cooperate with said die to cut a ribbon from said sheets, to displace said ribbon to one side of said sheet into said cavity and to deform said ribbon to increased width to prevent separation of said sheets, said cavity being shaped with increasing dimensions in one longitudinal direction to allow release of said ribbon from said cavity by relative longitudinal movement in said one direction.

2. A die set as set forth in claim 1, wherein said die cavity is provided with an open end through which said ribbon is removable without requiring movement between said ribbon and die cavity in a direction normal to said sheets.

3. A die set as set forth in claim 2, wherein said die cavity is tapered to provide a greater width in a direction of said open end.

4. A die set as set forth in claim 3, wherein said side walls diverge from said entrance in a direction toward said back wall providing said cavity with a dovetail-shaped cross section.

5. A die set as set forth in claim 4, wherein said back wall is a substantially flat surface.

6. A die set as set forth in claim 5, wherein said cutting edges taper in a diverging direction toward said open end, and said working portion of said punch is formed with a mating taper.

7. A die set as set forth in claim 6, wherein said working portion of said punch provides inclined sides which extend back from the end extremity thereof.

8. A die set as set forth in claim 1, wherein said die cavity is divergingly tapered in a longitudinal direction to provide said release of said ribbon from said die cavity.

9. A die set as set forth in claim 8, wherein said side walls diverge from said entrance toward said back wall providing said cavity with a dovetail-shaped cross section.

10. A die set as set forth in claim 1, wherein said die is formed in a single piece of material.

11. A die set for connecting a plurality of sheets of metal comprising a die and a punch, said die providing an elongated die cavity having a pair of opposed diverging cutting edges at the entrance thereof and a pair of opposed side walls which extend from said cutting edges to a back wall and diverge in a direction toward said back wall, said cutting edges being contained in a single plane, said cutting edges and cavity walls being fixed against relative movement, said punch having a working end having a width mating with said cutting edges and sides diverging back from the extremity thereof, said punch in cooperation with said die being operable to move ribbons of said sheet material into said die cavity and laterally deform a portion of said ribbons to substantially the size of said cavity, said ribbons being removable from said cavity by movement at least in part including relative longitudinal movement between said ribbons and die.

12. A die set as set forth in claim 11, wherein said cavity is formed with an open end through which said ribbons may be removed without movement in a direction perpendicular to said sheets.

13. A method of connecting a plurality of sheets comprising positioning said sheets in face-to-face contact adjacent to an elongated die cavity having side walls which diverge as they extend from the cavity entrance to a back wall said walls being fixed against relative movement, shearing superposed ribbon portions from each sheet into said cavity, moving said portions to one side of said sheets to form an opening in said sheets and to position said portions in said die cavity against said back wall, deforming said portion within said die cavity to a size preventing return movement thereof through said opening, releasing said deformed portions from said die cavity by relative movement therebetween in a direction lengthwise thereof, and forming said die cavity with increased cross section in said one direction lengthwise thereof so that longitudinal movement in said one direction causes an immediate release of substantial frictional contact between said portions and the walls of said cavity.

14. A method of connecting a plurality of sheet as set forth in claim 16, including providing said die cavity with an open end, and removing said deformed portions through said open end without requiring movement of said sheets in a direction perpendicular thereto.

15. A method of connecting a plurality of sheets as set forth in claim 18, including forming said die cavity in a single piece of substantially metal.

* * * * *

UNITED STATES PATENT AND TRADEMARK OFFICE

CERTIFICATE OF CORRECTION

PATENT NO. : 4,394,794

DATED : July 26, 1983

INVENTOR(S) : Richard Shirey

It is certified that error appears in the above-identified patent and that said Letters Patent is hereby corrected as shown below:

Column 4, line 9, "th" should read -- the --
line 35, "drive" should read -- die --.
Column 6, line 56, "16" should read -- 13 --.
line 61,"18" should read -- 14 --.
line 62, after "substantially", insert
-- rigid --.

Signed and Sealed this

*Seventeenth* Day of *January 1984*

[SEAL]

*Attest:*

GERALD J. MOSSINGHOFF

*Attesting Officer*

*Commissioner of Patents and Trademarks*